US005974943A

United States Patent [19]

Simonds

[11] Patent Number: 5,974,943

[45] Date of Patent: Nov. 2, 1999

[54] VARIABLE STROKE MOTOR AND VALVE

[76] Inventor: Edward L. Simonds, 2879 R Ave., Adel, Iowa 50003-8055

[21] Appl. No.: 08/795,034

[22] Filed: Feb. 5, 1997

[51] Int. Cl.[6] ..... F01L 33/02

[52] U.S. Cl. ..... 91/180; 92/140; 92/240; 74/129

[58] Field of Search ..... 91/180; 92/140, 92/240; 74/129

[56] References Cited

U.S. PATENT DOCUMENTS

| | | | |
|---|---|---|---|
| 1,115,470 | 10/1914 | Lipman | 91/180 |
| 1,291,642 | 1/1919 | Elwell | 74/129 |
| 1,939,887 | 7/1933 | Ferris et al. . | |
| 3,038,311 | 6/1962 | Linsley et al. | 91/180 |
| 3,938,426 | 2/1976 | Hunter | 92/140 |
| 4,538,505 | 9/1985 | Morillon . | |
| 4,838,145 | 6/1989 | Slocum et al. . | |
| 5,484,272 | 1/1996 | Horn | 418/35 |
| 5,485,905 | 1/1996 | Rader, III . | |

FOREIGN PATENT DOCUMENTS

| | | |
|---|---|---|
| 2347753 | 4/1974 | Germany . |

*Primary Examiner*—F. Daniel Lopez
*Attorney, Agent, or Firm*—Brown, Winick, Graves, Gross, Baskerville and Schoenebau, P.L.C.; Brett J. Trout

[57] ABSTRACT

A fluid valve system is provided for a variable stroke motor. The valve has a housing forming a cylinder, a first fluid input into the cylinder, a first fluid output out of the cylinder, a second fluid input into the cylinder, and a second fluid output out of the cylinder. Provided within the cylinder is a shaft provided with slots. As the shaft rotates into a first position, fluid communication between the first fluid input and the first fluid output is shut off, while fluid communication between the second fluid input and second fluid output is opened. As the shaft rotates to a second position, communication between the first fluid input and first fluid output is opened, while the communication between the second fluid input and the second fluid output is shut off. The device is preferably hooked up to a drive cylinder in fluid communication with the first fluid output and the second fluid input. A piston is provided within the drive cylinder. A fluid supply is operably coupled to the first fluid input and means are provided for rotating the shaft at a constant speed. As pressure of the fluid increases, the stroke of the piston increases, thereby generating a longer piston stroke, while the speed of the rotating shaft remains constant.

17 Claims, 4 Drawing Sheets

12
16
34
92
32
44
26
42
24
18
14
20
90
28
30
40
38
36
46
88
62
54
52
94
110
100
114
116
60
62
64
74
70
106
68
72
102
112
96
78
66
76
98
104
80
108
50

VARIABLE STROKE MOTOR AND VALVE

BACKGROUND OF THE INVENTION

1. Field of the Invention

The invention relates in general to a valve and associated piston actuated motor, and, more particularly, to a variable stroke motor and valve rotated at a constant speed.

2. Description of the Prior Art

In the prior art internal combustion piston-type devices, it is known to inject a liquid hydrocarbon into a piston assembly, draw the piston outward to create a vacuum strong enough to vaporize the hydrocarbon, and then compress the hydrocarbon before ignition thereof. Since the ignition of the hydrocarbon gas typically creates waste material and uses up most of the oxidizer within the piston assembly, work must be performed to remove the waste material and introduce fresh oxidizer into the piston assembly before more hydrocarbon may be combusted.

One drawback associated with the internal combustion engine is the pollution generated by such an engine. Additionally, since fuels typically do not burn cleanly in an internal combustion engine waste deposits build up within the piston which can either decrease the efficiency of the engine or require regular maintenance of the engine.

An additional drawback associated with internal combustion engines is the range of speeds at which typical internal combustion engines operate. Since internal combustion engines operate based upon a predetermined stroke length, the force of the combustion must be at least adequate to move the piston this predetermined stroke length. The force, however, must not be too large, otherwise components of the internal combustion engine may be damaged. Although the "force" of the stroke may be manipulated, the length of the stroke in an internal combustion engine typically cannot be varied. Accordingly, vehicles powered by internal combustion engines typically require a clutch and gearing to step up or step down the rotational energy produced by the internal combustion engine.

The difficulties encountered in the prior art discussed hereinabove are substantially eliminated by the present invention. The present invention is designed to provide a variable stroke motor with a constant speed rotating valve to increase efficiency and decrease the drawbacks associated with prior art internal combustion engines.

SUMMARY OF THE INVENTION

The present invention provides a fluid valve system comprising a valve housing and a shaft. The valve housing forms a hollow cylinder, a first fluid input, a first fluid output, a second fluid input and a second fluid output. The first fluid input and output and the second fluid input and output are all in fluid communication with the hollow cylinder. Positioned within the hollow cylinder is the shaft. The shaft is rotatable between a first position, substantially sealing off fluid communication between the first fluid input and the first fluid output, and a second position, substantially sealing off fluid communication between the second fluid input and the second fluid output. The shaft is provided with a first slot and a second slot, wherein the first slot is oriented on the shaft in a manner which opens fluid communication between the second fluid input and the second fluid output when the shaft is in the first position. The second slot is oriented on the shaft in a manner which opens fluid communication between the first fluid input and the first fluid output when the shaft is in the second position. Means are coupled to the shaft for rotating the shaft in the hollow cylinder between the first position and the second position.

In the preferred embodiment, the first fluid output and second fluid input are in fluid communication with a drive cylinder formed by a drive housing. A wobble-type piston is provided within the drive cylinder and means are provided for supplying the first fluid input with pressurized fluid such as steam. The piston is preferably coupled to a swing arm which, in turn, is connected by a sprag to a drive shaft. As the shaft within the hollow cylinder is rotated, the slots in the shaft alternately allow fluid to pass into the drive cylinder, through the first fluid input and first fluid output, and out of the drive cylinder, through the second fluid input and second fluid output. As pressure is increased, the length of the stroke of the piston increases, thereby increasing the speed at which the drive shaft is rotated. Preferably, a plurality of pistons may be coupled to the drive shaft to continue rotating the drive shaft as the first piston is on its return stroke.

DETAILED DESCRIPTION OF THE PREFERRED EMBODIMENT

Figure 1:
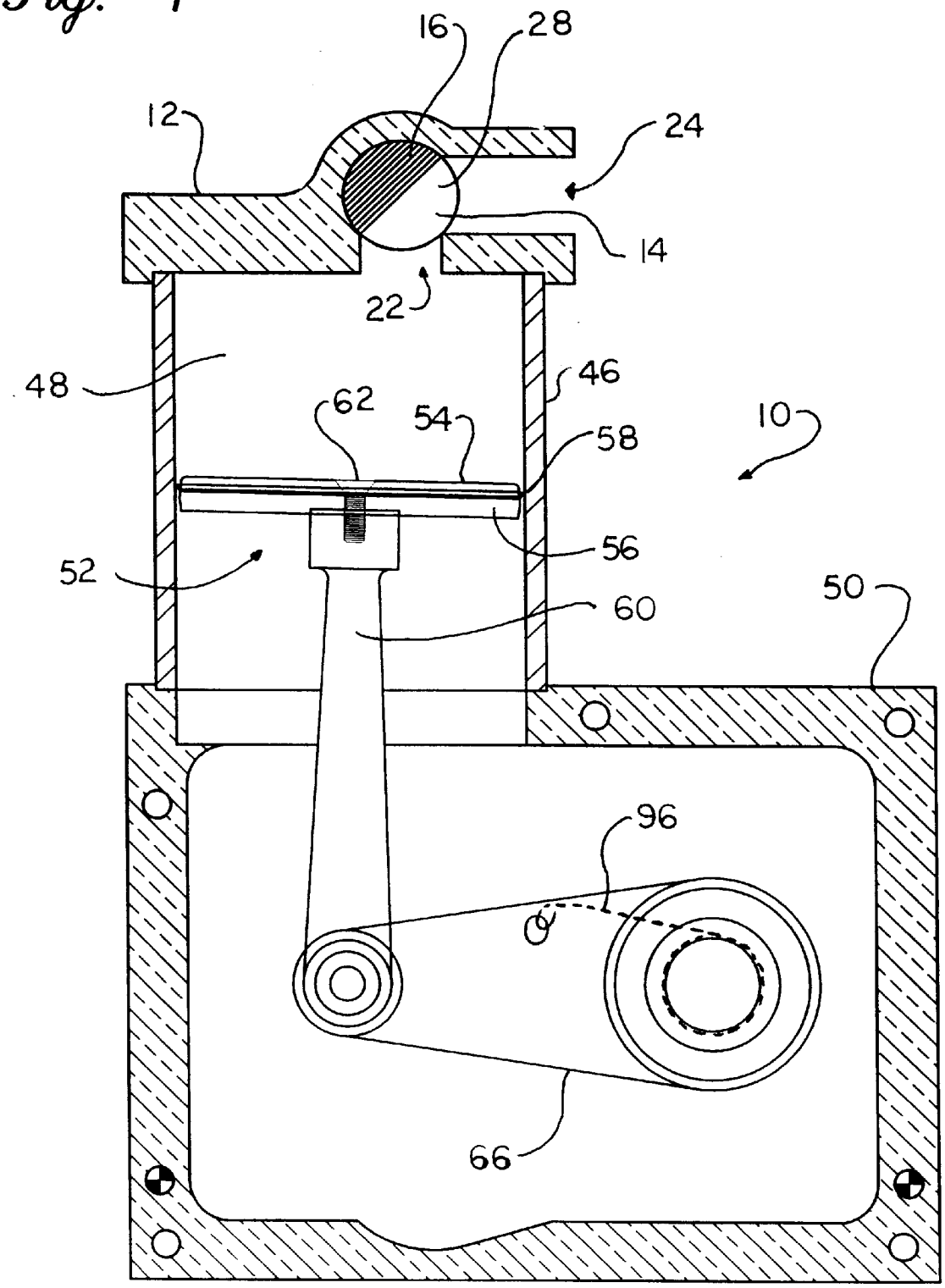
FIG. 1 is a side elevation in cross-section showing the valve assembly and piston assembly of the present invention.
Figure 3:
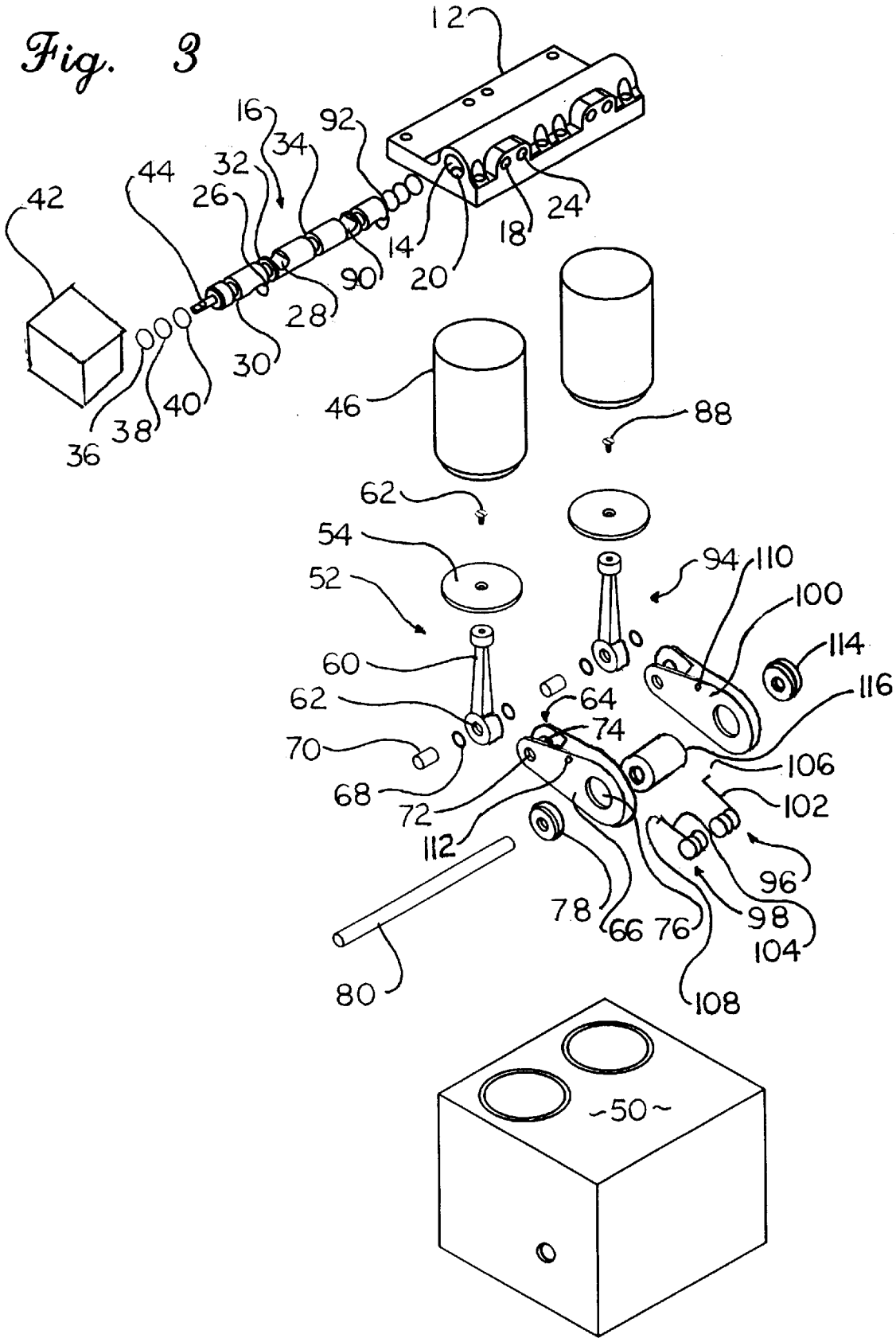
FIG. 3 is an exploded view of the valve assembly and piston assembly of FIG. 2.

With reference to the drawings, a variable stroke motor is indicated generally as 10 in FIG. 1. As shown in FIG. 3, the variable stroke motor includes a valve housing 12. In the preferred embodiment, the valve housing 12 is constructed of aluminum and provided with a hollow cylinder 14 to accommodate a valve shaft 16. The valve housing 12 is constructed to form a first fluid input 18 in fluid communication with the hollow cylinder 14 and a first fluid output 20 which is also in fluid communication with the hollow cylinder 14. As shown in FIG. 1, the valve housing 12 is also formed with a second fluid input 22 and a second fluid output 24.

As shown in FIG. 3, the valve shaft 16 is provided with a first slot 26 and a second slot 28. The valve shaft 16 is also provided with a first ring seat 30, a second ring seat 32, and a third ring seat 34. Provided on the first ring seat 30, second ring seat 32, and third ring seat 34 are three teflon rings 36, 38 and 40 which prevent the escape of fluid between the valve shaft 16 and hollow cylinder 14.

Figure 2:
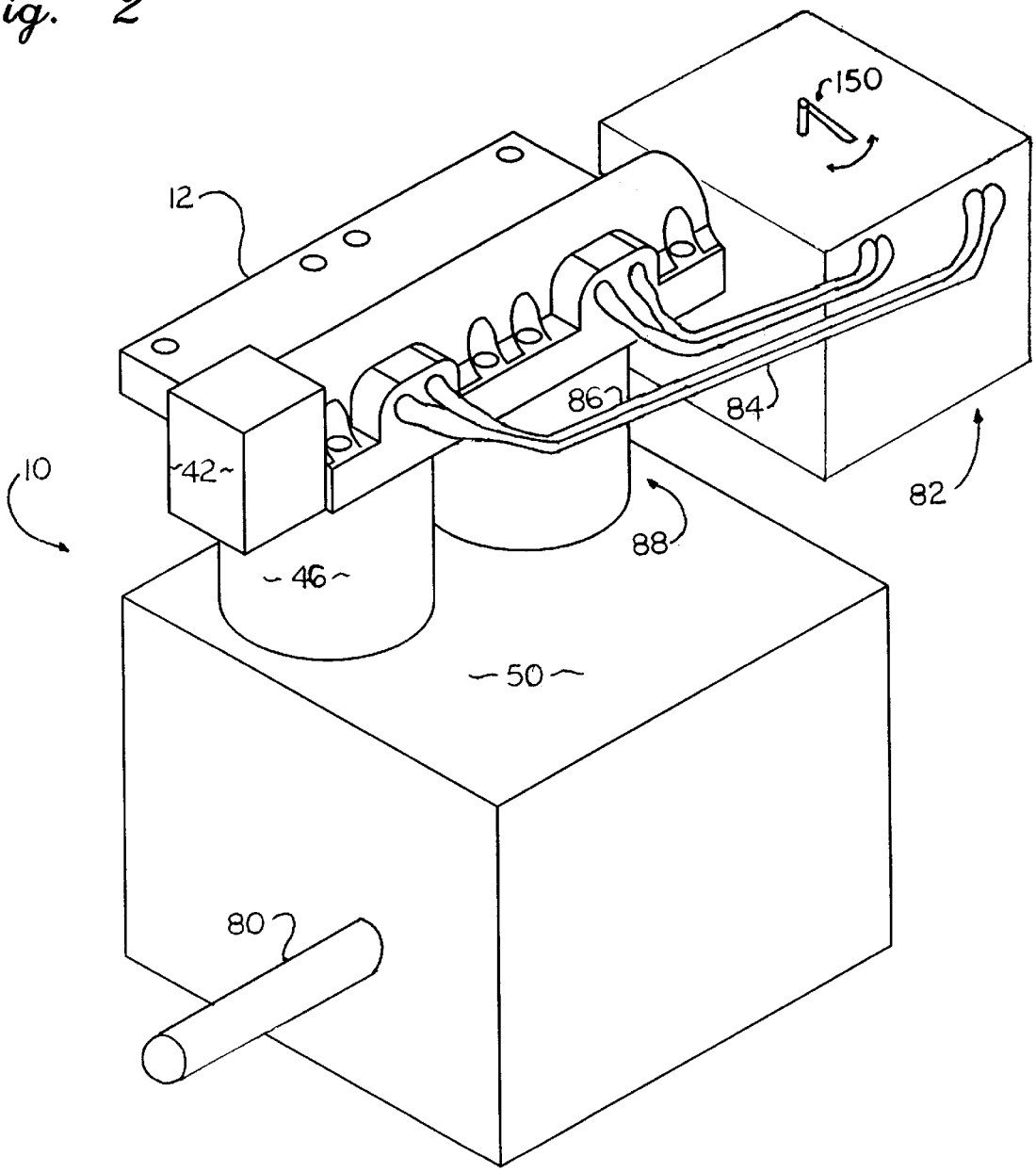
FIG. 2 is a perspective view of the valve assembly and piston assembly of FIG. 1.

As shown in FIG. 2, secured to the valve housing 12 is a shaft rotator 42 which is operably secured to the key 44 extending from the valve shaft 16 shown in FIG. 3. The shaft rotator 42 may be a small electric motor or any similar rotation device known in the art.

As shown in FIG. 3, the first slot 26 and second slot 28 of the valve shaft 16 are disposed on opposite sides of the valve shaft 16. Accordingly, when the valve shaft 16 is positioned within the hollow cylinder 14 of the valve housing 12, as shown in FIG. 1, the second slot 28 opens fluid communication between the second fluid input 22 and the second fluid output 24. When the second slot 28 opens fluid communication between the second fluid input 22 and second fluid output 24, as shown in FIG. 1, the first slot 26 is completely covered by the valve housing 12 (FIGS. 1 and 3). The portion of the valve shaft 16 on the opposite side of the first slot 26, therefore, seals off fluid communication between the first fluid input 18 and first fluid output 20.

Similarly, when the shaft rotator 42 rotates the valve shaft 16 one hundred and eighty degrees, the first slot 26 opens fluid communication between the first fluid input 18 and first fluid output 20, while the portion of the valve shaft 16 opposite the second slot 28 seals off fluid communication between the second fluid input 22 and second fluid output 28. In the preferred embodiment, the slots 26 and 28 and the inputs 18 and 22 and the outputs 20 and 24 are sized so that when the fluid communication between the first fluid input 18 and first fluid output 20 is open, fluid communication between the second fluid input 22 and second fluid output 24 is closed. Similarly, when fluid communication between the second fluid input 22 and second fluid output 24 is open, fluid communication between the first fluid input 18 and first fluid output 20 is closed.

Secured to the valve housing 12 is a drive housing 46 which forms a drive cylinder 48 as shown in FIG. 1. In the preferred embodiment, the drive housing 46 is constructed of stainless steel seamless tubing. Preferably, the drive housing 46 is secured to a drive box 50 which, is preferably constructed of aluminum. Provided within the drive cylinder 48 is a piston 52. The piston 52 is preferably constructed with an aluminum cap 54 and an aluminum base 56. As the piston 52 is of a wobble-type, the piston 52 is provided with a plastic sealing ring 58 which allows the piston 52 to pivot two degrees from a position normal to the center axis of the drive cylinder 48, while maintaining a seal between the sealing ring 58 and the drive housing 46.

A piston rod 60 preferably constructed of hardened steel is secured to the piston 52 with a securement screw 62 (FIG. 1). As shown in FIG. 3, the piston rod 60 is provided with an eyelet 62 which fits within a yoke 64 of a swing arm 66. Provided within the eyelet 62 is a needle roller bearing 68 or similar bearing known in the art to reduce friction. The needle roller bearing 68 is positioned within the eyelet 62, the eyelet 62 positioned within the yoke 64 and a dowel pin 70 constructed of heat treated steel is positioned through a first eyelet 72 of the yoke 64, the needle roller bearing 68, and a second eyelet 74 of the yoke 64. The dowel pin is preferably constructed of heat treated steel to withstand the large pressures associated with actuation of the piston rod 60. The swing arm 66 is preferably constructed of hardened steel and is provided with a large hole 76 to accommodate a pair of drive sprags 78. The drive sprags 78 are coupled to a drive shaft 80 in a manner which transfers rotational energy from the swing arm 66 to the drive shaft 80 on the drive stroke and which allows the drive shaft 80 to "freewheel" relative to the swing arm 66 on the recovery stroke so that the drive shaft 80 is not rotated in the opposite direction. As shown in FIG. 2, the drive shaft 80 extends through the drive box 50 to power a vehicle or any other drivable device.

Operably coupled in fluid communication with the first fluid input 18, is a fluid pressure generator 82 (FIG. 2). In the preferred embodiment, the pressure generator 82 is a steam generator, but the pressure generator 82 may, of course, be any similar device. The fluid pressure generator 82 is coupled to the first fluid input 18 via a transfer hose 84 (FIGS. 2 and 3). In the preferred embodiment, the second fluid output 24 is also coupled to the fluid pressure generator 82 by a supplemental transfer hose 86.

As shown in FIG. 2, the variable stroke motor 10 is also provided with a supplemental valve and piston assembly 88. The supplemental valve and piston assembly 88 is substantially similar in design to the assembly described above. As shown in FIG. 3, however, the valve shaft 16 is provided with a third slot 90 and a fourth slot 92 positioned on the valve shaft 16 in reverse of the positions of the first slot 26 and second slot 28. This positioning of the slots 26, 28, 90 and 92 causes the piston 52, described above, to drive when the piston 94 of the supplemental valve and piston assembly 88 is recovering, and to recover when the piston 94 of the supplemental valve and piston assembly 88 is driving. This complimentary actuation of the pistons 52 and 94 causes the drive shaft 80 to be substantially continuously driven by one of the two pistons 52 and 94.

Figure 4:
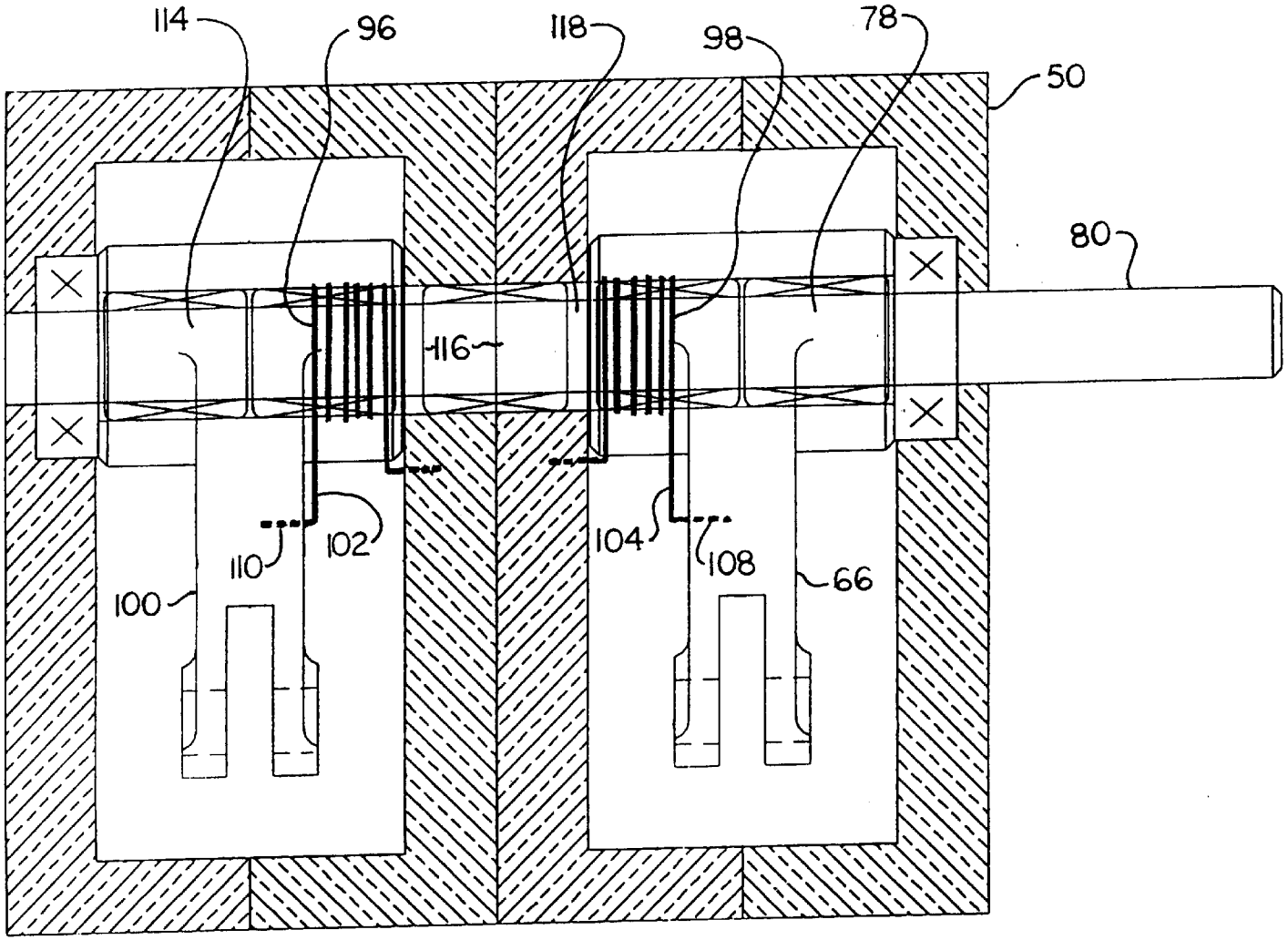
FIG. 4 is a top view in cross-section showing the valve and piston assembly of FIG. 1.

As shown in FIG. 4, two recovery springs 96 and 98 are provided to return the swing arm 66, described above, and the swing arm 100 of the supplemental valve and piston assembly 88 to a starting position. As each swing arm 66 and 100 alternately moves to a starting position, the swing arms 66 and 100 move their respective pistons 52 and 94 to a starting position as well. The recovery springs 96 and 98 are secured to the drive box 50 around the drive shaft 80. Each recovery spring 96 and 98 is provided with a recovery arm 102 and 104 and a securement finger 106 and 108. Once the recovery springs 96 and 98 are secured to the drive box 50, the fingers 106 and 108 are positioned within holes 110 and 112 provided in the swing arms 66 and 100. As shown in FIG. 4, the drive shaft 80, is coupled to the interior perimeters of a pair of drive sprags 114 which, in turn, are coupled on their exterior perimeters to the swing arm 100. The drive sprags 114 are oriented so that as the swing arm 100 is driven by the piston 94, the drive sprags 114 transfer the rotational motion of the swing arm 100 to the drive shaft 80. During the recovery stroke, the drive sprags 114 "freewheel" to allow the recovery spring 96 to return the swing arm 100 to its starting position without transferring a large amount of rotational energy to the drive shaft 80.

An anti-backlash sprag 116 is secured to the drive shaft 80 between the swing arms 66 and 100 to further reduce the transfer of rotational energy between the swing arms 66 and 100 and the drive shaft 80. As shown in FIG. 4, the anti-backlash sprag 116 is secured to the drive box 50 within a drive shaft opening 118 provided in the drive box 50 between the swing arms 66 and 100. The anti-backlash sprag 116 is secured to the drive box 50 by weldments or other similar securement means. The anti-backlash sprag 116 is similar in construction to the drive sprags 114, but is coupled to the drive shaft 80 in an opposite operational orientation relative to the drive sprags 114. Accordingly, when the swing arm 100 is in its drive stroke, the drive sprags 114 transfer rotational energy of the swing arm 100 to the drive shaft 80. During this drive stroke, the anti-backlash sprag 116 is in its "freewheel" orientation, allowing the drive shaft 80 to rotate freely. Once the swing arm 100 has finished its drive stroke, the recovery spring 96 returns the swing arm 100 to its starting position. As the recovery spring 96 rotates the swing arm 100, the drive sprags 114 are in their "freewheel" orientation which limits rotational energy transfer from the swing arm 100 to the drive shaft 80 and reduces the drag on the recovery spring 96.

The anti-backlash sprag 116 is provided to prevent any further rotation of the drive shaft 80 in the direction of the swing arm 100 recovery. If the friction between the drive sprags 114 and drive shaft 80 is great enough to transfer some amount of rotational energy from the drive sprags 114 to the drive shaft 80 during the recovery stroke of the swing arm 100, the anti-backlash sprag 116 prevents rotation of the drive shaft 80. Since the anti-backlash sprag 116 is welded to the drive box 50, the anti-backlash sprag 116 transfers any "backward" rotational energy of the drive shaft 80 to the drive box 50 to prevent rotation of the drive shaft 80 in the direction of the swing arm 100 recovery.

The anti-backlash sprag 116 continues to prevent backward rotation of the drive shaft 80 until one of the swing arms 66 or 100 begins rotating the drive shaft 80 on the drive stroke. In this way, the anti-backlash sprag 116, assures that the drive shaft 80 is rotated in only a single direction.

To operate the variable stroke motor 10 of the present invention, the shaft rotator 42 is actuated to rotate the valve shaft 16 within the hollow cylinder 14. The fluid pressure generator 82 is then actuated to supply a pressurized fluid, such as steam, to the first fluid input 18 and to the supplemental valve and piston assembly 88. The valve shaft 16 is thereby being rotated at a constant speed. When fluid is being applied at a low pressure to the first fluid input 18, only a small amount of fluid enters the drive cylinder 58 as the first slot 26 opens fluid communication between the first fluid input 18 and first fluid output 20. This introduction of fluid into the drive cylinder 48 forces the piston 52 away from the valve housing 12. As the swing arm 66 rotates, the eyelet 62 of the piston rod 60 pivots slightly as the swing arm 66 reciprocates. This pivoting of the piston rod 60 causes the entire piston 52 to tilt slightly relative to the drive cylinder 48. To reduce the amount of tilt, the piston 52 is arranged so that in both its starting position and its ending position the piston 52 is slightly tilted. This reduces the degree of tilt of the piston 52 when the piston is at the center of a full stroke. The swing arm 66 and piston rod 60 are preferably designed with lengths sufficient to place the piston 52 in a starting position wherein the piston 52 is tilted two degrees from normal, relative to the center axis of the drive cylinder 48.

To examine how the piston 52 tilts, it is desirable to examine a full stroke of the piston 52, that is, when fluid is being applied to the first fluid input 18 at full pressure. As the drive cylinder 48 begins to fill with fluid the piston 52 moves toward the swing arm 66 causing the piston 52 to move away from the valve housing 12, thereby pushing the swing arm 66 which begins to rotate. As the swing arm 66 rotates, the piston rod 60 pivots within the yoke 64 of the swing arm 66. The piston 52 continues to rotate until the piston 52 becomes normal to the center axis of the drive cylinder 48. This occurs when the piston 52 is one-quarter of the way through the full stroke of the piston 52.

As more fluid enters the drive cylinder 48, the piston 52 continues to pivot away from the drive shaft 80 until the piston 52 is halfway through its full stroke as shown in FIG. 1. At this point, the piston 52 is two degrees from normal relative to the axis of the drive cylinder 48, but in a direction opposite the two degree orientation of the starting point. As the drive cylinder 48 continues to fill with fluid, the swing arm 66 rotates further, until the piston 52 is three-quarters of the way through its full stroke. At this point the swing arm 66 has rotated sufficiently so that the piston 52 is again normal to the center axis of the drive cylinder 48. As the drive cylinder 48 continues to fill with fluid, the swing arm 66 continues to rotate, and the piston 52 moves toward a position two degrees from normal relative to the center axis of the drive cylinder 48. This two degree tilt is in the same direction as the two degree from normal orientation of the piston 52 at the starting point of the full stroke. At full fluid pressure, this full stroke occurs every time fluid communication is opened between the first fluid input 18 and the first fluid output (FIG.3).

Accordingly, instead of orienting the piston 52 normal to the center axis of the drive cylinder 48 in the starting position and pivoting the piston 52 through a large angle as the swing arm 66 rotates through its cycle, the piston 52 is oriented two degrees from normal to start. In this way the piston 52 starts at a position two degrees from normal, cycles through a normal position, a position two degrees from normal in the opposite direction, another normal position, and finally a position two degrees from normal in the same direction as the starting position. The total amount of deviation from the normal position is thereby kept to a minimum throughout the full stroke.

Although the variable stroke motor 10 is fully capable of cycling through the full stroke noted above, this full stroke is only realized under full fluid pressure. When only a small amount of pressure is being applied to the first fluid input 18, the piston 52 moves through a much shorter stroke cycle. As the pressure of the fluid supplied by the fluid pressure generator 82 increases, a larger amount of fluid passes from the first fluid input 18, through the first fluid output 20 and into the drive cylinder 48 with each rotation of the valve shaft 16. This larger amount of fluid entering the drive cylinder 48 moves the piston 52 more quickly, thereby generating a longer and longer stroke. The swing arm 66 translates this longer stroke into a greater rotation of the drive shaft 80. Since the shaft rotator 42 rotates the valve shaft 16 at a constant speed, each cycle takes the same amount of time, regardless of the pressure of the fluid being applied. Accordingly, a greater rotation of the drive shaft 80 in the same amount of time translates into a greater speed of the drive shaft 80.

For each rotation of the valve shaft 16, the second slot 28 provided on the valve shaft 16 opens fluid communication between the second fluid input 22 and second fluid output 24 one time (FIG. 1). During this period of time, the force of the recovery spring 96 causes the swing arm 66 to push the piston rod 60 into the piston 52, thereby pushing fluid out of the drive cylinder 48 through the second fluid input 22 and second fluid out 24. The fluid is thereafter returned to the fluid pressure generator 82 through the supplemental transfer hose 86, so that the fluid can again be pressurized and recirculated through the motor 10 (FIG. 2). As the piston 52 is being driven, the supplemental valve and piston assembly 88 is working in a reciprocating manner, to drive the drive shaft 80 when the piston 52 is in its recovery stroke. As noted above, the anti-backlash sprag 116 prevents the swing arms 66 and 98 from transferring rotational energy to the drive shaft 80 during their recovery stroke.

Since the valve shaft 16 is rotated at a constant speed, varying the amount of fluid pressure entering the first fluid input 18 causes the piston 52 to stroke a longer distance, and thereby drive the drive shaft 80 a greater distance during the same interval. The fluid pressure generator 82 may be provided with a heating adjustment control 120, such as a propane valve, to vary the amount of heat delivered to the fluid pressure generator 82 and, thereby, the pressure of the fluid. Accordingly, the variable stroke motor 10 can directly convert a larger amount of heat energy into a faster rotation of the drive shaft 80.

The foregoing description and drawings merely explain and illustrate the invention, and the invention is not limited thereto, except insofar as the claims are so limited, as those skilled in the art who have the disclosure before them will be able to make modifications and variations therein without departing from the scope of the invention. For example, it is anticipated that any number of supplemental valve and piston assemblies may be coupled to the drive shaft 80, and that a wide variety of dimensions are available for the fluid inputs and fluid outputs of the valve housing and for the slots in the valve shaft.

What is claimed is:

1. A fluid valve system comprising:

(a) a valve housing forming:

(i) a hollow cylinder;

(ii) a first fluid input in fluid communication with said hollow cylinder;

(iii) a first fluid output in fluid communication with said hollow cylinder;

(iv) a second fluid input in fluid communication with said hollow cylinder;

(v) a second fluid output in fluid communication with said hollow cylinder;

(b) a valve shaft positioned within said hollow cylinder, said valve shaft being rotatable between a first position substantially sealing off fluid communication between said first fluid input and said first fluid output, and a second position substantially sealing off fluid communication between said second fluid input and said second fluid output;

(c) wherein said valve shaft is provided with a first slot and a second slot;

(d) wherein said first slot is oriented on said valve shaft in a manner which opens fluid communication between said second fluid input and said second fluid output when said valve shaft is in said first position;

(e) wherein said second slot is oriented on said valve shaft in a manner which opens fluid communication between said first fluid input and said first fluid output when said valve shaft is in said second position; and (f) means coupled to said valve shaft for rotating said valve shaft between said first position and said second position.

(g) a drive housing which forms a drive cylinder in fluid communication with said first fluid output and said second fluid input;

(h) a piston cap located within said drive cylinder;

(i) a piston rod secured to said piston cap;

(j) a swing arm pivotally secured to said piston rod;

(k) a drive shaft;

(l) a sprag operably secured between said swing arm and said drive shaft; and (m) means for reciprocating said piston rod at a first stroke length and for reciprocating said piston rod at a second stroke length wherein said first stroke length is greater than said second stroke length.

2. The fluid valve system of claim 1, wherein said means for reciprocating said piston rod at said first and said second stroke lengths further comprises means for supplying fluid to said first fluid input.

3. The fluid valve system of claim 2, further comprising means for varying a pressure at which said fluid is supplied to said first fluid input.

4. The fluid valve system of claim 1, further comprising means provided on said piston cap for maintaining a substantially fluid tight seal between said piston cap and said drive housing as said piston cap is rotated at least two degrees from a position normal to an axis running through said drive cylinder.

5. The fluid valve system of claim 1, further comprising a backlash sprag operably secured to said drive shaft.

6. The fluid valve system of claim 5, further comprising means for biasing said piston to push fluid out of said drive cylinder.

7. The fluid valve system of claim 6, wherein said biasing means is a spring.

8. The fluid valve system of claim 1, further comprising:

(a) a supplemental valve housing forming:

(i) a supplemental hollow cylinder;

(ii) a first supplemental fluid input in fluid communication with said supplemental hollow cylinder;

(iii) a first supplemental fluid output in fluid communication with said supplemental hollow cylinder;

(iv) a second supplemental fluid input in fluid communication with said supplemental hollow cylinder;

(v) a second supplemental fluid output in fluid communication with said supplemental hollow cylinder;

(b) wherein said valve shaft is positioned within said supplemental hollow cylinder;

(c) wherein said first position of said valve shaft substantially seals off fluid communication between said second supplemental fluid input and said second supplemental fluid output;

(d) wherein said second position of said valve shaft substantially seals off fluid communication between said first supplemental fluid input and said first supplemental fluid output;

(e) wherein said valve shaft is provided with a third slot and a fourth slot;

(f) wherein said third slot is oriented on said valve shaft in a manner which opens fluid communication between said first supplemental fluid input and said first supplemental fluid output when said valve shaft is in said first position; and (g) wherein said fourth slot is oriented on said valve shaft in a manner which opens fluid communication between said second supplemental input and said second supplemental output when said valve shaft is in said second position.

9. The fluid valve system of claim 8, wherein said means for reciprocating said piston rod at said first and said second stroke lengths further comprises means for supplying fluid to said first fluid input and said first supplemental fluid input.

10. The fluid valve system of claim 9, further comprising means for varying a pressure at which said fluid is supplied to said first fluid input and said first supplemental fluid input.

11. The fluid valve system of claim 8, further comprising a supplemental drive housing forming a supplemental drive cylinder in fluid communication with said first supplemental fluid output and said second supplemental fluid input.

12. The fluid valve system of claim 11, further comprising a supplemental piston located within said supplemental drive cylinder.

13. The fluid valve system of claim 12, wherein said supplemental piston comprises a supplemental piston cap secured to a supplemental piston rod, further comprising:

(a) a swing arm pivotally secured to said piston rod, (b) a supplemental swing arm pivotally secured to said supplemental piston rod; and (c) a supplemental sprag secured between said supplemental swing arm and said drive shaft.

14. The fluid valve system of claim 13 wherein said supplemental piston comprises a supplemental piston cap secured to a supplemental piston rod, further comprising:

(a) a supplemental swing arm pivotally secured to said supplemental piston rod; and (b) a supplemental sprag secured between said supplemental swing arm and said drive shaft.

15. The fluid valve system of claim 14, further comprising a backlash sprag secured to said drive shaft.

16. The fluid valve system of claim 15, further comprising:

(a) means for biasing said piston to force fluid out of said drive housing; and (b) supplemental means for biasing said supplemental piston to force fluid out of said supplemental drive cylinder.

17. The fluid valve system of claim 16, wherein said biasing means is a spring and wherein said supplemental biasing means is a supplemental spring.

* * * * *